United States Patent [19]

Bretthauer

[11] 4,099,289

[45] Jul. 11, 1978

[54] TOOL HAVING REMOVABLE CLEANING ELEMENT

[75] Inventor: Harry Bretthauer, Carson City, Nev.

[73] Assignee: James B. Manning, Carson City, Nev. ; a part interest

[21] Appl. No.: 775,060

[22] Filed: Mar. 7, 1977

[51] Int. Cl.[2] ..... A47L 13/46; B25G 1/12

[52] U.S. Cl. ..... 15/244 R; 15/145

[58] Field of Search ..... 15/26, 120 A, 147 R, 15/147 A, 147 B, 147 C, 147 D, 228, 229 A, 244 R, 145, 209 D

[56] References Cited

U.S. PATENT DOCUMENTS

| | | | |
|---|---|---|---|
| 2,877,483 | 3/1959 | Alvistur | 15/244 R X |

FOREIGN PATENT DOCUMENTS

| | | | |
|---|---|---|---|
| 863,691 | 3/1961 | United Kingdom | 15/147 R |
| 793,386 | 4/1958 | United Kingdom | 15/147 R |

*Primary Examiner*—Daniel Blum

*Attorney, Agent, or Firm*—Clarence A. O'Brien; Harvey B. Jacobson

[57] ABSTRACT

An elongated rod is provided including opposite ends and a pair of end members are removably rotatably mounted on the opposite ends of the rod. The opposite rod ends include first endwise outwardly facing abutment friction surfaces and the end members include second abutment friction surfaces opposing and frictionally engaged with the corresponding first friction surfaces. An elongated flexible tension member is anchored at its opposite ends to the end members and is spiraled about the rod intermediate the end members in a tensioned condition, whereby the tension member retains the end members on the opposite ends of the rod and the frictional engagement between the first and second friction surfaces prevents relative rotation of the end members relative to the rod and thereby maintains the tension member in a spiraled condition about the rod. A cleaning structure in the form of a rag, brush head, sponge, etc., is carried by one of the end members and the rod may be utilized as a handle for the cleaning structure. In addition, an extension handle is provided and is removably engageable with the other end member to provide a handle for the cleaning structure of a greater length.

10 Claims, 4 Drawing Figures

TOOL HAVING REMOVABLE CLEANING ELEMENT

BACKGROUND OF THE INVENTION

Various forms of handled cleaning tools have been heretofore provided embodying an elongated support structure with one end thereof comprising a handle and the other end thereof having a cleaning structure, such as a rag, sponge, or brush, etc., secured thereto. However, although various attaching structures have been provided for attaching cleaning structures to one end of an elongated handle, most of these attaching structures are specifically adapted to removably attach a particular cleaning structure to the handle. Further, many of the attaching structures utilized for this purpose are of complex nature, expensive to produce, difficult to manipulate and/or subject to corrosion. Accordingly, a need exists for a simplified elongated handle including relatively simple and easily operable structure for attaching a cleaning head or other cleaning structure to one end thereof.

Examples of handled cleaning structures, including some of the general structural and operational features of the instant invention, are disclosed in U.S. Pat. Nos. 234,124, 315,814, 880,260, 1,212,032, and 1,494,171.

BRIEF DESCRIPTION OF THE INVENTION

The cleaning tool of the instant invention comprises an elongated handle or rod equipped with attaching structure whereby a cleaning head in the form of a rag, sponge, or other cleaning apparatus may be removably attached to one end thereof.

The main object of this invention is to provide a cleaning tool which will be convenient to use in various cleaning environments.

Yet another object of this invention is to provide a cleaning tool including an elongated handle with one end thereof adapted to comprise a hand grip and the other end of the tool equipped with structure whereby a cleaning head of suitable design may be readily removably attached thereto.

Still another important object of this invention is to provide a cleaning tool which will be adaptable for use in conjunction with various forms of cleaning heads.

A further object of this invention is to provide a cleaning tool which will not be susceptible to corrosion by cleaning materials.

A final object of this invention to be specifically enumerated herein is to provide a cleaning tool in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
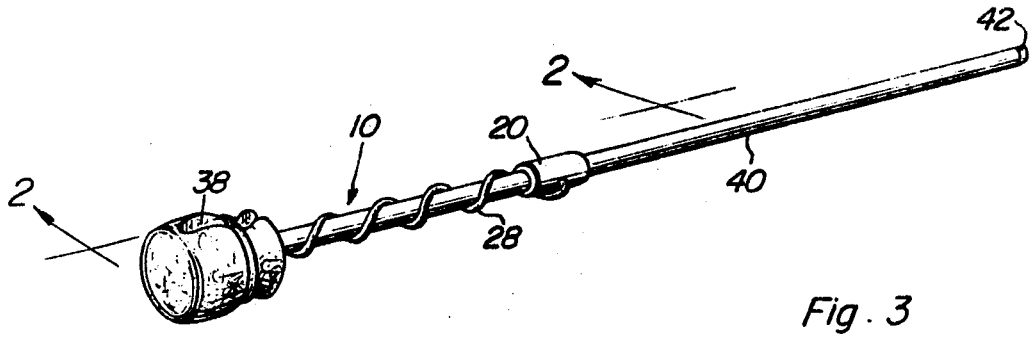
FIG. 1 is a perspective view of the cleaning tool of the instant invention.
Figure 3:
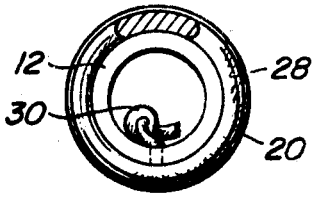
FIG. 3 is an enlarged, transverse, vertical, sectional view taken substantially upon the plane indicated by the section line 3—3 of FIG. 2.
Figure 2:
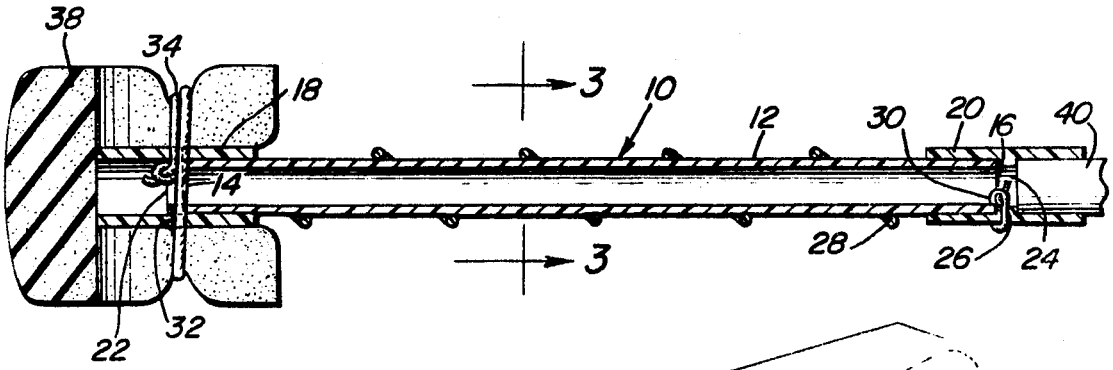
FIG. 2 is an enlarged, fragmentary, longitudinal, vertical, sectional view taken substantially upon the plane indicated by the section line 2—2 of FIG. 1.
Figure 4:
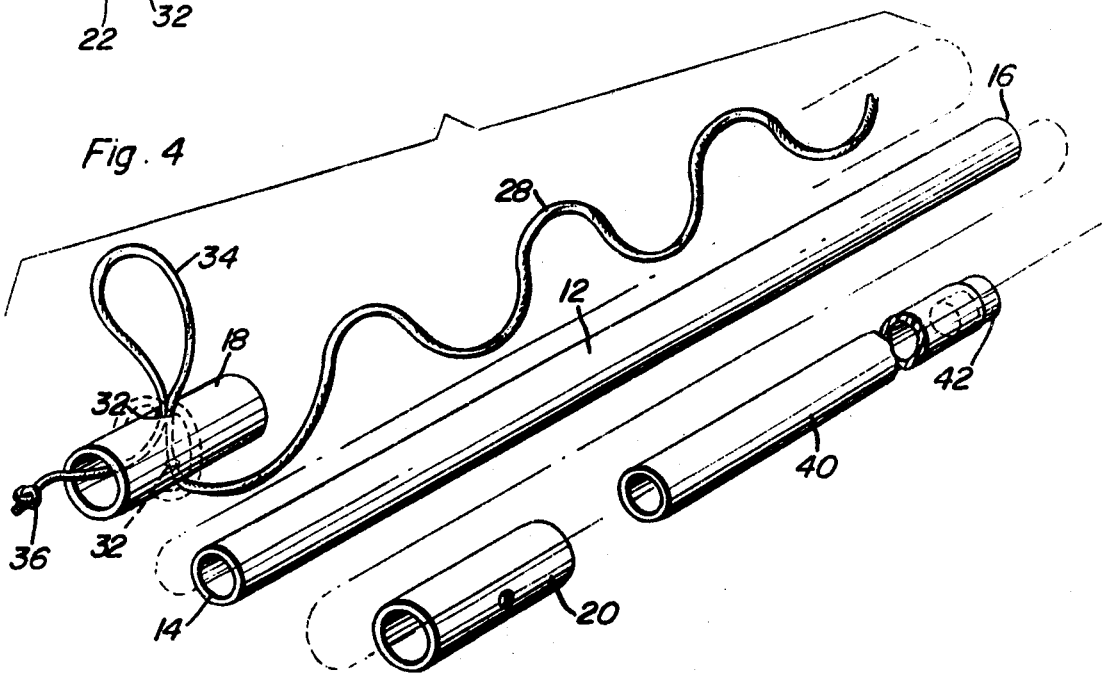
FIG. 4 is an exploded perspective view of the cleaning tool holder.

Referring now more specifically to the drawings, the numeral 10 generally designates the cleaning tool of the instant invention. The tool 10 includes an elongated tubular rod 12 provided with opposite end faces 14 and 16. A pair of tubular end members 18 and 20 are telescopingly engaged over the ends of the rod 12 and the end members include internal circumferential flanges 22 and 24 whose adjacent axial end faces define friction abutment surfaces abutted against and frictionally engaged with the end faces or edges 14 and 16 of the rod 12.

The end members 18 and 20 are rotatably mounted on the opposite ends of the rod 20 and the engagement of the end faces 14 and 16 of the rod 12 with the opposing axial end faces of the flanges 22 and 24 define limits of movement of the end members 18 and 20 toward each other along the rod 12.

The end member 20 is provided with a radial bore 26 which opens inwardly through the inner periphery of the flange 24 and one end of an elongated multi-strand flexible tension member 28 is passed inwardly through the bore 26 and knotted as at 30 so as to anchor that end of the tension member 28 relative to the end member 20. Further, the end member 18 is provided with a pair of similar diametrically opposite radial bores 32 and the end of the tension member 28 remote from the bore 26 is initially passed through the bores 32 from one side of the end member 18 and has a loop 34 formed therein on the other side of the end member 18 and then the terminal end of the tension member 28 is passed back inwardly through the bore 32 from which the loop 34 extends and is knotted as at 36 inwardly of the end member 18.

A cleaning element in the form of a sponge panel 38 is placed over the end of the end member 18 remote from the end member 20 and its peripheral portions projecting outwardly of the end member 18 are folded back upon the latter with the loop 34 passed over the outer end of the end member 18 so as to be encircled about the cleaning structure or sponge panel 38. Thereafter, either the end member 18 or the end member 20 may be rotated relative to the rod 12 in order to cause the tension member 28 to be spiraled about the rod 12 and to be frictionally engaged with the latter in a tensioned state. When the tension member 28 has thus been coiled or spiraled about the rod 12, the tensioning of the member 28 prevents movement of the end members 18 and 20 from the ends of the rod 12, tightens the loop 34 about the sponge panel or other cleaning structure 38 and maintains the end faces 14 and 16 of the rod 12 in tight frictional engagement with the opposing surfaces of the flanges 22 and 24. Thus, the end members 18 and 20 are frictionally maintained in position on the ends of the rod 12 against angular displacement relative thereto. Of course, if it is desired to replace the cleaning structure or sponge panel 38 with a different cleaning structure, the same may be applied over the end member 18 in substantially the same manner in which the loop 34 anchors the cleaning structure 38 over the end member 18.

If the rod 12 does not provide a handle of sufficient length, an extra elongated cylindrical rod 40 may have one end thereof frictionally telescoped into the end of the end member 20 remote from the end member 18. In this manner, an extension handle for the tool 10 may be provided.

It is to be noted that the rod 12 and end members 18 and 20 may conveniently be constructed of polyvinyl chloride and therefore that the tool 10 will resist substantially any corrosive cleaning materials. Further, the tension member 28 may be constructed of nylon so as to also be corrosion resistant and the rod 40 may also be constructed of polyvinyl chloride with the end thereof remote from the end member 20 closed by means of a removable plug 42.

The cleaning structure may be readily removed for rinsing or replacement purposes merely by rotating one of the end members 18 and 20 so as to loosen the tension member 28 on the rod 12 and thereby allowing the loop 34 to be increased in size sufficiently to enable the cleaning structure 38 to be disengaged from the end member 18.

Of course, cleaning of the tool 10 is greatly simplified by its being constructed of polyvinyl chloride and the tool 10 is also nonconductive and may, therefore, be utilized around electrical equipment without fear of the user receiving an electrical shock.

The tool can be utilized for many purposes about the home and it may also be utilized in many industrial applications. Further, the tool 10, including the cleaning structure 38, may be utilized as a washing brush during bathing and the components of which the tool 10 is constructed are readily available at low cost. Accordingly, the tool 10 may be marketed at a price substantially all persons will be able to afford.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A cleaning tool comprising an elongated rod, a pair of end members rotatably mounted on the opposite ends of said rod, said opposite ends including first endwise outwardly facing abutment friction surfaces, said end members including second abutment friction surfaces opposing and frictionally engaged with the corresponding first friction surfaces, and an elongated flexible tension member anchored at its opposite end portions to said end members and spiraled about said rod intermediate said end members, one of said opposite end portions including a looped portion and a cleaning element anchored to one of said end members by said looped portion of said tension member which is tightened thereabout by rotating one of the end members relative to the rod.

2. The combination of claim 1 wherein said end members include sleeve members telescopingly and rotatably mounted on the ends of said rod, said sleeve members including internal abutment flanges whose opposing surfaces define said second abutment surfaces.

3. The combination of claim 2 wherein said rod is tubular and said first abutment surfaces are defined by the opposite axial end faces of said tubular rod.

4. The combination of claim 3 wherein said rod and sleeve members are constructed of dielectric plastic material.

5. The combination of claim 1 wherein said tension member is constructed of multi-strand plastic material.

6. The combination of claim 5 wherein said multi-strand plastic material comprises nylon and said tension member is therefore at least slightly stretchable.

7. The combination of claim 1 wherein said end members include sleeve members telescopingly and rotatably mounted on the ends of said rod, said sleeve members including internal abutment flanges whose opposing surfaces define said second abutment surfaces, one of said sleeve members having a first radial bore formed therein opening into the interior of said one sleeve through the corresponding abutment flange, said one end portion of said tension member being passed inwardly through said radial bore and anchored within said one sleeve member.

8. The combination of claim 7 wherein the other sleeve member includes a pair of generally axially aligned second radial bores formed therein, the other end portion of said tension member being passed inwardly through one of said second bores, outwardly through the other second bore, looped outwardly of said other second bore and then passed inwardly through said other second bore and anchored within said other sleeve member, said loop comprising said looped portion anchoring said cleaning structure to the last mentioned sleeve member.

9. The combination of claim 8 wherein said rod is tubular and said first abutment surfaces are defined by the opposite axial end faces of said tubular rod.

10. The combination of claim 9 wherein said rod and sleeve members are constructed of dielectric plastic material.

* * * * *